US007079005B2

(12) United States Patent
Cochran

(10) Patent No.: US 7,079,005 B2
(45) Date of Patent: Jul. 18, 2006

(54) MECHANICALLY BUFFERED CONTACT WIPER

(76) Inventor: Gary D. Cochran, 2870 Page Ave., Ann Arbor, MI (US) 48104

( * ) Notice: Subject to any disclaimer, the term of this patent is extended or adjusted under 35 U.S.C. 154(b) by 0 days.

(21) Appl. No.: 10/999,681

(22) Filed: Nov. 30, 2004

(65) Prior Publication Data

US 2005/0116809 A1 Jun. 2, 2005

Related U.S. Application Data

(60) Provisional application No. 60/525,737, filed on Dec. 1, 2003.

(51) Int. Cl.
*H01C 10/30* (2006.01)

(52) U.S. Cl. ..... 338/118; 338/162

(58) Field of Classification Search ..... 338/118, 338/139, 142, 143, 157, 158, 160, 162, 176, 338/185, 186, 307
See application file for complete search history.

(56) References Cited

U.S. PATENT DOCUMENTS

| | | | | |
|---|---|---|---|---|
| 1,963,554 | A * | 6/1934 | McDill | 338/118 |
| 3,477,056 | A * | 11/1969 | Pedu | 338/135 |
| 3,717,837 | A * | 2/1973 | MacLachlan | 338/121 |
| 3,727,166 | A * | 4/1973 | Kobayashi | 338/163 |
| 4,732,802 | A | 3/1988 | Bosze et al. | |
| 4,751,492 | A * | 6/1988 | Tsuzuki et al. | 338/176 |
| 4,931,764 | A | 6/1990 | Gaston | |
| 5,035,836 | A * | 7/1991 | Gardos | 252/511 |
| 5,111,178 | A | 5/1992 | Bosze | |
| 5,265,168 | A * | 11/1993 | Schiess et al. | 381/69 |
| 5,475,359 | A * | 12/1995 | Hatayama et al. | 338/160 |
| 6,369,690 | B1 * | 4/2002 | Chen | 338/160 |
| 6,392,529 | B1 * | 5/2002 | Liu | 338/202 |
| 6,617,377 | B1 | 9/2003 | Chacko | |
| 6,681,628 | B1 | 1/2004 | Sawert et al. | |
| 2002/0075130 | A1 * | 6/2002 | Taguchi et al. | 338/160 |
| 2004/0130432 | A1 * | 7/2004 | Hatayama | 338/308 |
| 2004/0251826 | A1 * | 12/2004 | Schlenker | 313/512 |

FOREIGN PATENT DOCUMENTS

| | | | | |
|---|---|---|---|---|
| DE | 2726134 | * | 12/1978 | |
| JP | 1-207902 | * | 8/1989 | 338/162 |
| JP | 2-49406 | * | 2/1990 | 338/157 |
| JP | 3-211706 | * | 9/1991 | 338/160 |
| JP | 6-53014 | * | 2/1994 | 29/610.1 |

* cited by examiner

*Primary Examiner*—Tu Hoang
(74) *Attorney, Agent, or Firm*—George L. Boller

(57) ABSTRACT

An electric device contains a medium interposed between first and second electric elements to provide electric continuity between the first element and a defined reference point of the second element throughout a defined range of sliding travel of one of the elements along the medium in a direction that is transverse to a favored direction of conduction through an electrically anisotropic conductive region of the medium that is composed of electric conductors that conduct in a favored direction and are electrically separated by solid dielectric.

16 Claims, 6 Drawing Sheets

MECHANICALLY BUFFERED CONTACT WIPER

CROSS-REFERENCE TO RELATED APPLICATION AND PRIORITY CLAIM

This non-provisional application derives from the following commonly owned co-pending patent application, the priority of which is expressly claimed: Provisional Application No. 60/525,737 filed on 1 Dec. 2003 in the name of Gary Cochran bearing the title "Mechanically Buffered Contact Wiper".

FEDERALLY-SPONSORED RESEARCH OR DEVELOPMENT

Not Applicable

TECHNICAL FIELD OF THE INVENTION

The present invention is directed to the field of an electrical contact wiper moveable to a position that controls current or voltage to a resistive or conductive material, and/or to an electrical element. It includes the field of single and multiple electrical contact switches such as a simple on-off switch or the selection of encoder tracks.

BACKGROUND OF THE INVENTION

The number of operational mechanical cycles for a resistive potentiometer is limited by wear characteristics of a wiper moving over a resistive track. Many inventions have been patented to increase the lifetime of a potentiometer or variable resistor by reducing mechanical wear between the wiper and resistive track. U.S. Pat. No. 4,732,802 to Wayne P. Bosze, et. al. proposes to screen conductive islands onto a resistive track, allowing for reduced contact force, thereby extending life. The wiper may still come into contact with the material of the resistive track, thereby causing wear and/or the conductive islands may wear through. A similar technical approach is taught in U.S. Pat. No. 5,111,178, also by Bosze, whereby an admixture of conducting spheres and fibers are screened as integral components of the resistive track, and protruding above the resistive material. These additional components reduce wear directly on the resistive material, and reduce the required contact force. A similar idea is taught in U.S. Pat. No. 6,617,377 by Anthony Chacko. He suggests the use of nanocomposite compositions. The conductive material becomes a component of the resistive track material formulation and therefore limits the available materials for design of a resistive track.

Accordingly, it's desirable to invent a wear resistant surface that doesn't limit selection of a resistor material.

The most successful idea used in the vehicular industry to increase the lifetime of a potentiometer for a fuel level sender is taught in U.S. Pat. No. 4,931,764 by Robert Gaston. The invention is to place conductive bars or segments beneath a resistive track, said segments being connected by traces brought out in a planar or lateral direction away from the resistive material. A wiper rides on top of the displaced conductive segments or commutator bars. These commutator bars can be made from harder, longer-wearing material alloys and may have a lower coefficient of friction, resulting in a longer life for the potentiometer. But the lifetime is still not as long as desired. Also, the use of silver in commutator bars for fuel senders results in an adverse chemical reaction with fuel additives. Gold has been proposed as a replacement for silver in order to reduce undesirable chemical interactions. But, this adds cost to the product.

Accordingly, it's desirable to reduce the wear between a moving contact and a resistive or conductive track without using laterally displaced commutator bars. It's also desirable not to use precious metals or metals that may interact with a corrosive environment.

In order to reduce chemical interactions that may affect tracks or commutator bars containing silver, U.S. Pat. No. 6,681,628 B2 by Sawert, et. al. teaches a combination of two conductive ink printings, one of which is free from silver. The silver-free ink is printed directly over a resistive track containing silver. A wiper rides over this printed track, thus providing a harder and more chemically resistant wear-surface. However, the use of segmented bars described in the patent may result in wear of the resistive track as the wiper travels from bar to bar. If any part of this printing wears through, silver in the resistive track may become exposed to chemical effects.

U.S. Pat. No. 6,444,102 by Tucci teaches that a wiper made of carbon fibers can have a very long lifetime. A carbon fiber wiper is sold by Micro Contacts, Inc., 62 Alpha Plaza, Hicksville, N.Y. 11801-2695, and the company has tested a design with a durability of 500 million cycles while sliding on a surface. A resistive track cannot normally survive nearly as many cycles, and is therefore the basic limitation for designing a long life potentiometer or variable resistor.

Accordingly, a means for increasing the lifetime of a resistive track with a long lifetime wiper is desirable.

Another type of resistive potentiometer in current use today is a throttle position sensor (TPS) or a pedal position sensor (PPS). Both may have a wiper moving directly on a carbon based resistive track with no commutator bars. Even though these sensors have longer lifetimes than fuel level senders, even greater lifetimes with low wear and low electrical noise characteristics are desirable.

A moveable wiper used to select conductive patterns other than a resistive track is also desirable. A wiper with one or more prongs, said prongs isolated or in combination, may serve as a switching element, directly controlling current passing through selected parts of a conductive pattern. Multiple wiper prongs may select multiple contact conductors through the wiper movement and contact. In many of these cases, the highly conductive material may be soft and mechanical wear may limit the useful life of the conductor-wiper combination. An example of this kind of product is an absolute digital encoder that that may be used to measure and/or transmit angles for machine tool control and surveying equipment.

Accordingly, it's desirable to have a wiper-conductor system with long lifetime of wear for use with conductive tracks made of soft material.

Small D.C. motors have commutators and brushes (contact wipers) subject to severe mechanical wear. Separation of conductive areas for commutation is accomplished with air or insulating material gaps, redirecting coil current after a contact wiper passes into a new region. While the brush is in a commutator area relatively large with respect to the material thickness, the commutator is isotropically conductive. Although a commutator can be made with very high wear characteristics, wear is still a major problem for some applications.

Accordingly it is desirable to have a commutator and brush assembly with a very long life while using soft, highly conductive materials for current flow to the coils.

Yet another application is a very long lived contact switch whereby the wiper has some sliding motion during engagement with another component of the switch. Simple electrical contact switches may require millions of switch closures, and are therefore subject to wear. Versions of these switches may be used as cam-operated switches to control timing of operational cycles. The invented buffer allows very soft, highly conductive, materials on one side and hard, long-wearing materials on the contact side of these switches.

In all of these cases an improved wiper and contactor assembly with extended wear is desirable.

SUMMARY OF THE INVENTION

A mechanical buffer made from an electrically anisotropic, conductive material or geometric equivalent is interposed between a wiper and underlying electrical components including, but not limited to, resistive or conductive tracks and/or semiconductor components. The buffer is made from material that is highly resistant to mechanical wear, and may also have a low coefficient of friction. Therefore, resistive track(s) or electrical contacts protected by the buffer can be made of materials that may not survive significant mechanical wear from a wiper sliding in direct contact.

The buffer may be bonded to the surface on which a track is mounted, thereby sealing and isolating the resistive track in a 3-dimensional structure. The buffer material is selected to be resistant to chemical effects in the region of the wiper, and with low permeability for transfer of chemical components through the thickness of the buffer. Therefore, adverse chemical reactions between the resistive track material and the wiper environment are eliminated.

Accordingly, a bonded, mechanical buffer will protect underlying track materials or components from mechanical wear or corrosion.

A geometrical arrangement of conductors and non-air insulators can equivalent to a mechanical buffer material herein described if it provides for anisotropic electron flow in space, along with desired wear characteristics. Grouping a number of parallel, insulated wires together into a 3-dimensional arrangement can be an equivalence. As an example of a conductive wire based anisotropic arrangement, magnetic coils are often made with insulated copper wire. Electron flow is constrained to the wire and does not pass between the closely wound wires. However, soft copper doesn't exhibit good wear characteristics against mechanical contact friction from a wiper and cannot be considered a good material for a mechanical buffer.

The term "resistive track" is used in the following discussion, but it shall mean all electrical elements or components that can be printed, mounted, or otherwise electrically contacting a surface, including active devices. The term should not be construed as a limitation and those skilled in the art will see other uses for the invention.

DETAILED DESCRIPTION

Figure 1A:
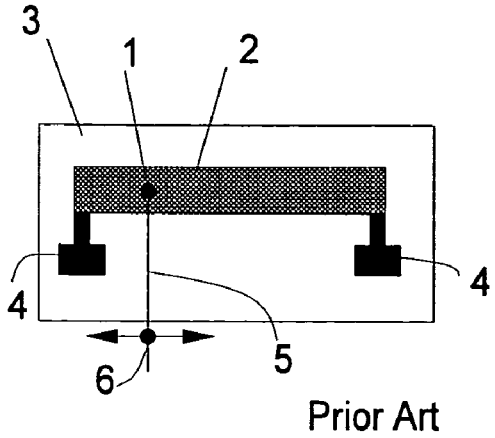
FIG. 1A Prior Art Potentiometer.
Figure 1B:
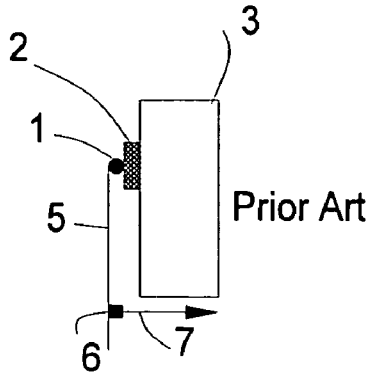
FIG. 1B Prior Art Potentiometer Side View.

FIGS. 1A, 1B show a known potentiometer design whereby a wiper 1 slides directly on a resistive track 2 mounted or printed on a substrate 3. An arm 5 is mechanically moved to move the wiper. Although the track is shown as mounted along a line, it may be in almost any pattern, such as an arc when a wiper is pivoted about an axis. Conductive termination pads 4 connect the potentiometer to wires that are used to connect to external circuits (not shown) In some circuit uses only one pad 4 will be connected to an external circuit. Often a center tap 6 is used to split the potentiometer into two resistors each between the center tap and a respective one of the pads, with a wire 7 shown as an output lead. For a simple trimmer application the lifetime is adequate. For millions of repetitive cycles or closed loop servo operations the lifetime may be much too short.

Figure 2A:
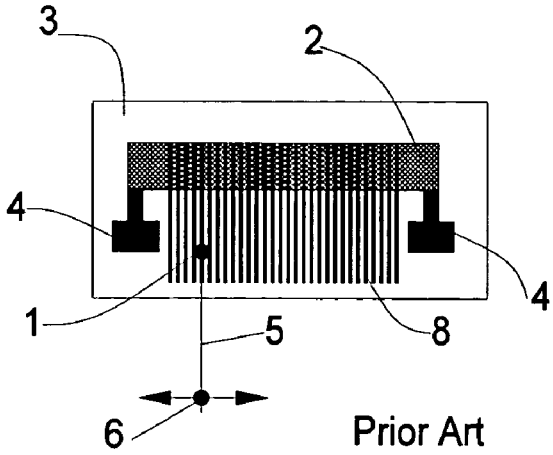
FIG. 2A Prior Art Potentiometer With Displaced Commutator Bars.
Figure 2B:
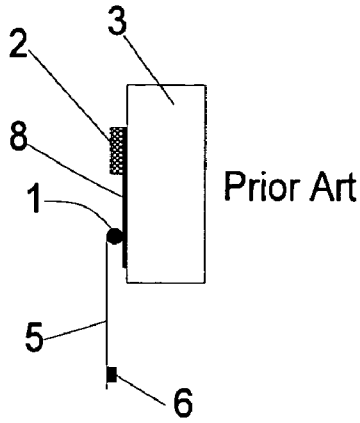
FIG. 2B Side View of FIG. 2A.

FIGS. 2A, 2B show a prior art potentiometer design used extensively in a fuel level sender. The commutator bars 8 over which wiper 1 slides are passed under the resistive track 2, and are made of materials that have better wear characteristics. This design is commercially successful for vehicular fuel level senders. More recently, modern fuel additives have caused chemical interaction problems with materials used in commutator bars.

Figure 3A:
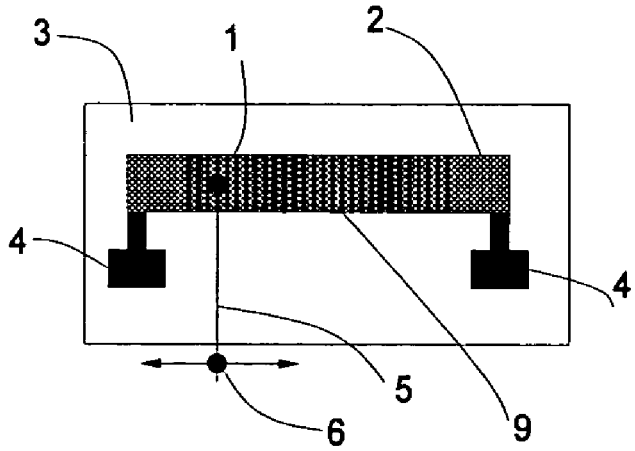
Prior Art Fig. 3A
FIG. 3A Prior Art Potentiometer With Superimposed Commutator Bars.
Figure 3B:
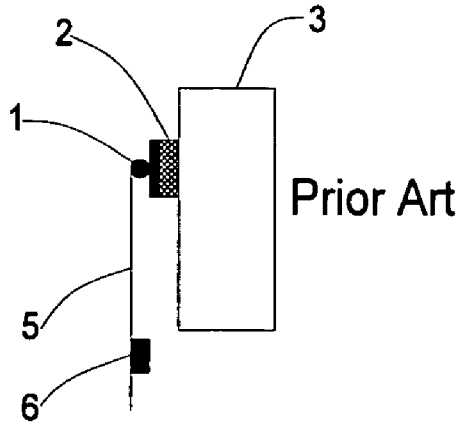
Prior Art Fig. 3B
FIG. 3B Side View of FIG. 3A.

FIGS. 3A, 3B show a potentiometer design to reduce the effects of chemical interaction between silver and sulfur compounds in vehicular fuel level senders. A printing 9 over the resistive track 2 is made without silver, protecting the underlying resistive track 2 that may contain silver. The material is isotropically conductive, with air used as separator material between conductive bars. Although it has not been used commercially, the invention teaches a reduction of chemical interactions. However, it's still subject to wear-through of the overprinted material leading to potentiometer failures.

Figure 4A:
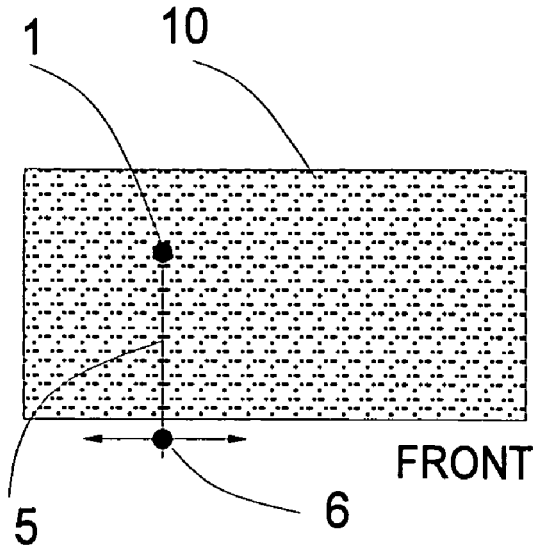
FIG. 4A Front View of Anisotropic Conductive Buffer Material.
Figure 4B:
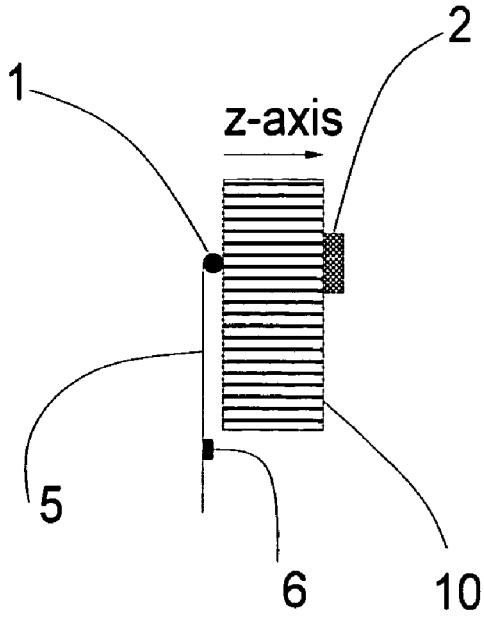
FIG. 4B Side View of FIG. 4A With Track.
Figure 4C:
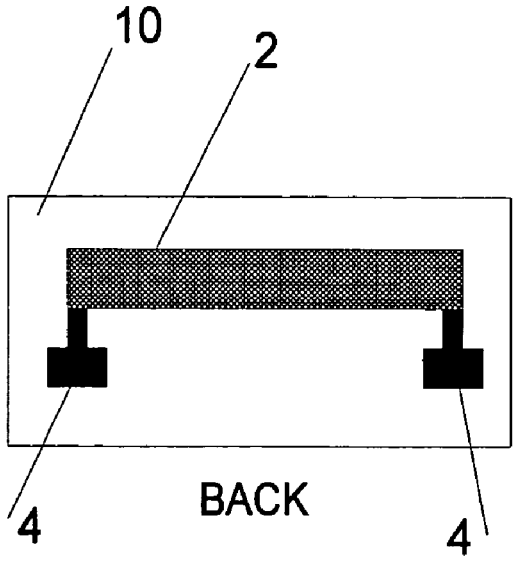
FIG. 4C Back View of Buffer With Track.

FIGS. 4A, 4B, 4C show a preferred embodiment of the present invention. Two surfaces are shown. A second, or back surface of a buffer 10 is printed with a resistive track 2 and a first, or front surface of buffer 10 is separated from the back surface by a finite thickness of material that is electrically anisotropic with conduction in the thickness or z-axis direction. Lateral or planar current transfer at any point on the buffer surface is greatly reduced.

This kind of material is known by various names such as an anisotropic conductor, an interposer, or a Z-axis conductor. There are no significant differences between these three terms as used in this invention. Development of this technology over the past decade has been mostly directed to interconnecting layers of multi-layer printed circuit boards. Active and passive components, circuits, or traces can be mounted at different depths on different surfaces. It is believed that mechanical wear from a sliding wiper has not been considered with respect to these applications, although such applications may experience a relatively low number of cycles of vertical sliding engagement by a connector or test probe.

A wiper 1 in FIG. 4A moves on the buffer front surface and makes electrical contact with the buffer back surface by means of anisotropic electrical conduction through the thickness of the buffer material. The separation material and the conductive components producing anisotropic conductivity of said buffer material can be made from material elements more wear resistant and more chemically inert than the materials used to make the underlying electrical elements such as conductive or resistive tracks 2. The front surface of the buffer that has contact with wiper 1 may also have a lower coefficient of friction than the underlying electrical elements. This invention covers any system with at least two surfaces or interfaces, one of which is in contact with a movable wiper and separated by an anisotropic conductor from the other surface or interface on which a resistive track is mounted.

The basic invention can be practiced with only two surfaces, or even with a separate, conductively anisotropic coating over a resistive track similar to U.S. Pat. No. 6,681,628 B2, but without the requirement for segmented bars of isotropically conductive materials. However, a thin material buffer may require a support structure with greater mechanical strength.

Figure 5A:
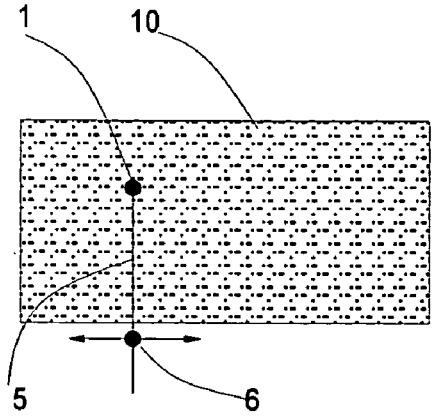
FIG. 5A Wiper Buffered—Track on Substrate.
Figure 5B:
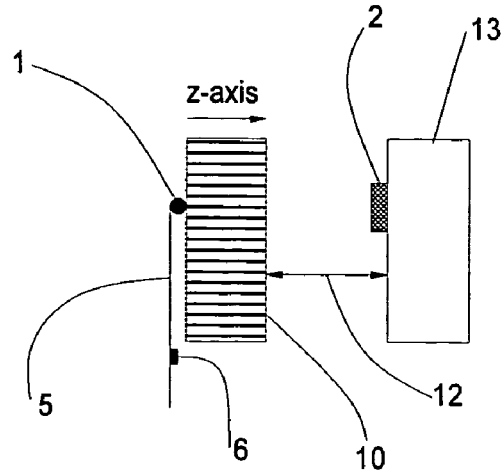
FIG. 5B Side View of FIG. 5A.

FIGS. 5A, 5B show a system with two separate material components comprising four surfaces. The resistive track 2 is bonded either to a material substrate 13 (as shown) or to the buffer, and the substrate and the buffer are bonded together as shown by 12. The interfaces thereby become embedded in a 3-dimensional structure. The wear surface may be disposed directly over a resistive track, or it may be spaced from the track in a lateral direction, providing connection of current, voltage, or wires to a resistive track by depositing conductive lines or patterns over or under the resistive track.

Figure 6A:
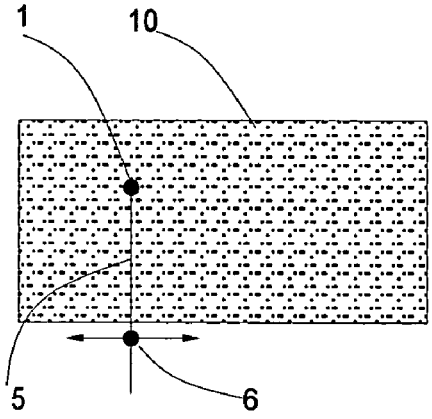
FIG. 6A Wiper Buffered—Multiple Layers.
Figure 6B:
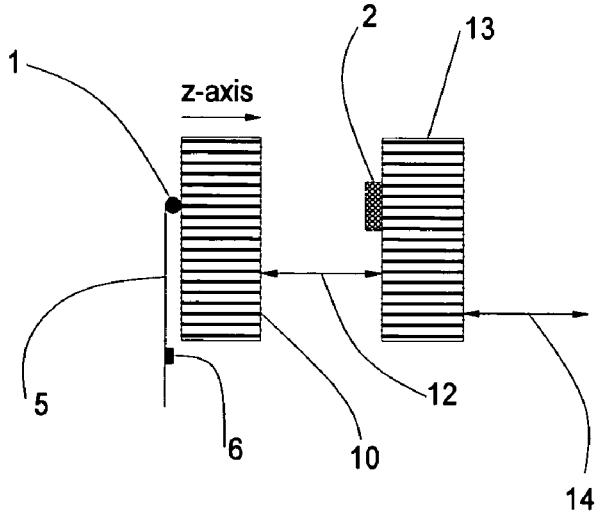
FIG. 6B Side View of FIG. 6A.

FIGS. 6A, 6B show the basic invention extended to multiple layers by converting substrate 13 to a z-axis conductor and adding additional z-axis conductors 14. Conductive paths can even be reversed from right to left with output occurring at surfaces previously representing inputs. Almost any 3-dimensional conductive path structure is possible.

The buffer material is a 3-dimensional structure with short, vertical, electrical connections between the wear surface and the resistor track, whether embedded or not. Connections can be made by a random conductor pattern, thereby reducing noise. The connections may also be a patterned arrangement of vias or openings that form a commutator bar pattern, also reducing noise by averaging. Vias in this context can be any random or patterned set of filled openings whether circular or other transverse shape. The buffer provides a means of electrically connecting to a resistive track with no direct, mechanical contact between a movable wiper and said track.

The anisotropic conductors shown in FIGS. 5A, 5B, 6A, and 6B are made from material satisfying desirable parameters for hardness, wearability, low coefficient of friction, and other conditions that may be needed to extend the life of a contact moving over the surface. U.S. Pat. No. 6,790,425 teaches how to make a thin layer of carbon fullerenes or nanotubes. It's probable that a considerably greater thickness can be achieved, useable as the anisotropic material herein described.

It's also feasible to make a binder material with a large number of threads or channels for conduction, as described in U.S. Pat. No. 6,804,105. The binder may be a hard ceramic such as presently used in some long life potentiometers.

Figure 7A:
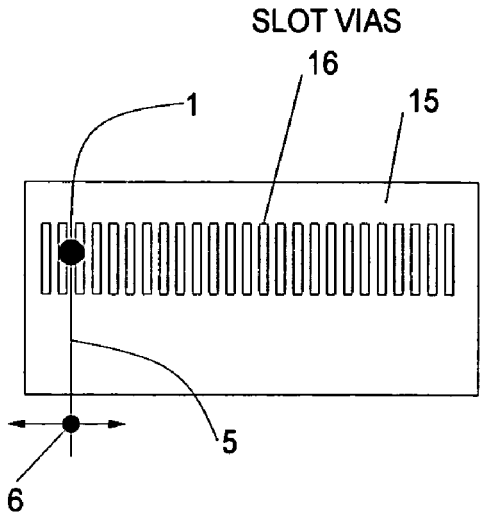
FIG. 7A LTCC With Via Slots.
Figure 7B:
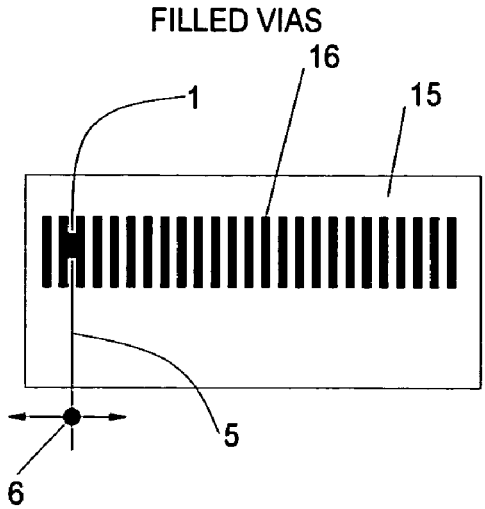
FIG. 7B LTCC With Filled Conductive Slots.

An alternative embodiment for making an anisotropic conductor is to insert vias in a thin substrate like a ceramic material $Al_2O_3$ (Alumna), and then fill the vias with a hard, long wear-life electrical conductor. FIG. 7A shows a Low Temperature Co-Fired Ceramic (LTCC) 15, sometimes called Green Tape, prepared with vias 16, either randomly positioned or patterned, as shown. The Green Tape may be only 100 microns thick (0.004 inches or about the thickness of transparent tape found on a desktop or a piece of paper), but thicker than an ink printing or screening. The vias 16 are filled with a conductive material as shown in FIG. 7B, selected for high conductivity, high wearability, and a low coefficient of friction.

Figure 8A:
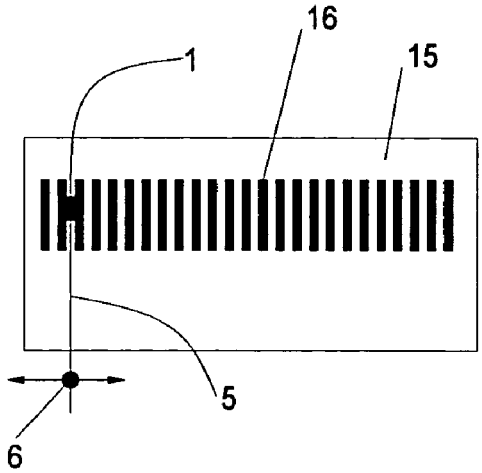
FIG. 8A LTCC Z-Axis Conductive Vias With Track on Substrate.
Figure 8B:
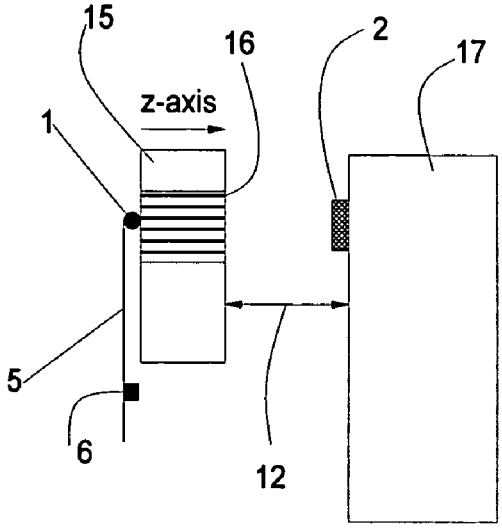
FIG. 8B Side View of FIG. 7B With Added Track on Substrate.

FIG. 8B shows a thick film resistive track screen printed onto a ceramic substrate 17. The LTCC 15 is placed over the substrate 17 and is co-fired with the substrate, completely covering that portion of the resistive track 2 normally subject to wear from a moving wiper 1 in direct contact with the track 2. The process of co-firing results in a via filled anisotropic conductor in intimate, merged, contact with the underlying, interspatial resistive track. Although each individual via may be isotropically conductive, the effect of a pattern of small vias is to isolate conduction through the wiper to a small volume where conduction is vertical. The track is embedded in a ceramic structure with interconnections primarily in the thickness direction.

The front surface of the LTCC 15 is the surface on which the wiper moves, and Alumina provides extremely high resistance to mechanical wear. Various via fill materials can be used including Tungsten, Titanium, Nickel, Hard coated Copper, Carbon or Carbon fibers, fullerenes, including buckyballs or nanotubes, nanocomposites, and various alloys of these and other materials. An important feature is to use a long wearing, conductive material that is essentially at the same height as the surrounding insulating ceramic material after co-firing. U.S. Pat. No. 6,626,684 by Stickler, et al describes a socket with vias filled with carbon nanotubes (fullerenes). This material may be ideal for a movable wiper interface buffer.

When the vias are mechanically contacted by a wiper, they create an electrical connection to the underlying resistive track. Separation of the mechanically wearable material from the resistive track allows for a significant improvement in the number of cycles over which the system can operate. Any wear that occurs is between the wiper and the front surface of the LTCC. Since there is no direct sliding action between the wiper and the resistive track, track wear cannot occur.

Figure 9A:
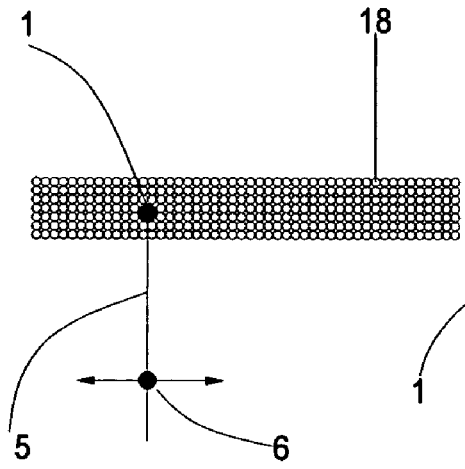
FIG. 9A Insulated Wire Buffer in Vertical Arrangement.
Figure 9B:
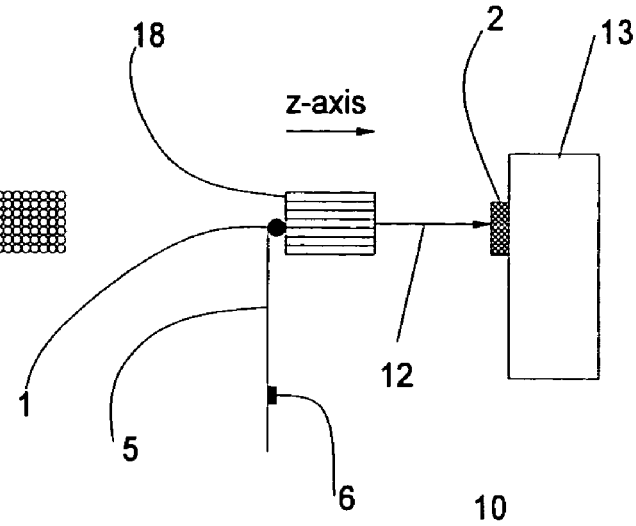
FIG. 9B Side View of FIG. 9A.

Another embodiment of this invention is an arrangement of insulated wires in a vertical or planar arrangement. FIGS. 9A and 9B show an arrangement of insulated, conductive wires 18 grouped together in the vertical direction. The insulation coating on each wire is not shown. This is similar to a microscopically, anisotropic material, but is made with relatively large (e.g. 0.004") diameter wire. The wire material must be wear resistant, such as Nichrome or Nickel. The wire insulation material separates the wires from each other, thereby creating an anisotropic electron flow structure. The wire arrangement 18 must be bonded as at 12 to the structure 13 with the resistive track 2.

Figure 10A:
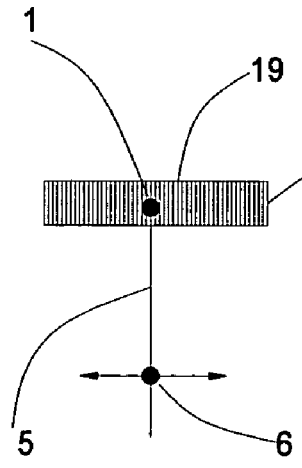
FIG. 10A Insulated Wire Buffer in Planar Arrangement.
Figure 10B:
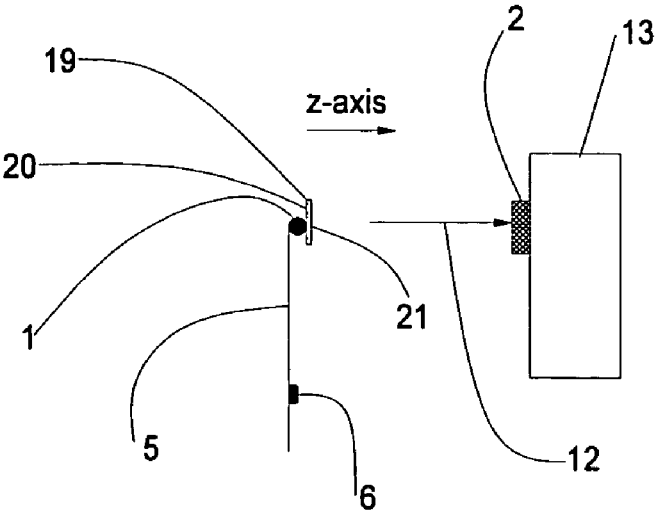
FIG. 10B Side View of FIG. 1A.

FIGS. 10A and 10B show a planar, insulated wire arrangement 19. The wires are laid down side by side with an insulation coating preventing electron flow from any one wire to its neighbor. In this case it's necessary to grind, lap or otherwise remove insulation from both the front 20 and back 21 of the parallel wire arrangement in order to provide a wiper contact surface and a resistive track contact surface. However, insulation between the wires is not removed, thereby allowing anisotropic flow characteristics for the geometric arrangement. The wire arrangement 19 must be bonded as at 12 to the structure 13 with the resistive track 2 in contact with the back surface of the wire arrangement.

This invention can also be used as an improved brush and commutator assembly for motors, especially, but not limited to, DC motors. In a standard DC motor, non-moving brushes or wipers are connected to a voltage or current supply. They make electrical contact with two or more conductive regions on a motor rotor that sequentially direct current to different coils of the motor. Instead of direct contact between a brush and these regions, the rotor surface is covered with an electrically anisotropic buffer material. FIGS. 5A and 5B demonstrates this idea. The brush 1 to buffer 10 interface is made with wear characteristics better than the brush 1 to conductor 2 interface. Current through the buffer only has to pass through the z-axis thickness of the buffer before being directed to the coils by the more conductive material 2 underneath the buffer.

An additional advantage of the invention is that a buffer can also provide for chemical isolation of the embedded tracks from the environment in which the wiper is moved, such as a surrounding corrosive liquid or gas. This feature was also pointed out in U.S. Pat. No. 6,804,105 but it was not used to support the moveable action of a wiper. As long as the buffer material is not adversely affected, has low permeability to the liquid, liquid vapor, or other gas in the neighborhood of the wiper, the underlying component elements are not degraded by chemical interactions. For example, silver can be freely used in the track of a potentiometric fuel level sender with buffer, even in the presence of sulfur compounds, as long as it's merged into the ceramic material beneath a low permeable, isolating buffer material such as the LTCC tape and conductive vias. The same is true for printed carbon ink tracks. It is also true for Micro-Electro-Mechanical-Systems (MEMS) used to make sensors and actuators.

It should be clear to those skilled in the art that the same invention may be used to make single or multiple switched conductors with much longer switch lifetimes than presently possible, and with isolation from chemical effects.

What is claimed is:

1. An electric device comprising: a medium that comprises generally parallel opposite surfaces, at least one of which is substantially flat, and low resistance electric conductors electrically separated by solid dielectric and aligned to conduct anisotropically in a favored direction between the opposite surfaces, the medium being interposed between first and second electric elements to provide a region of anisotropic, low resistance electrical connection between the first element and a defined reference point of the second element throughout a defined range of sliding travel of one of the elements alon a flat one of the surfaces of the medium in a direction that is transverse to the favored anisotropic direction, wherein the second element comprises a surface on which is printed, deposited, or otherwise bonded a lengthwise extending conductive track, and the one element is arranged for sliding travel along a path on a flat one of the surfaces of the medium whose length parallels the length of the conductive track, wherein the conductive track comprises one or more discontinuities at locations alan its length, and the medium extends along the lengthwise extent of the track to both cover the track and bridge the discontinuities, and wherein the medium comprises a random or patterned array of the electric conductors disposed, aligned, and electrically insulated from each other within the solid dielectric such that each electric conductor extends from the one surface of the medium along which the one element slides to the opposite surface of the medium that is contacting the second element, with the solid dielectric providing low conductivity laterally between conductors.

2. An electric device as set forth in claim 1 wherein the conductive track comprises a resistive track.

3. An electric device as set forth in claim 2 wherein the resistive track is continuous along its lengthwise extent.

4. An electric device as set forth in claim 1 wherein the one surface of the medium along which the one element slides presents to the one element a hardness that is greater than the hardness that the second element would present to the one element.

5. An electric device as set forth in claim 4 wherein the coefficient of friction between the one surface of the medium and the one element is less than the coefficient of friction that would be present between the one element and the second element.

6. An electric device as set forth in claim 1 wherein the dielectric comprises a ceramic material, and at the one surface of the medium, the electric conductors present to the one element a hardness that is greater than the hardness that the second element would present to the one element.

7. An electric device as set forth in claim 1 wherein the dielectric comprises a ceramic material, and at the one surface of the medium, the electric conductors present to the one element a coefficient of friction that is less than the coefficient of friction that the second element would present to the one element.

8. An electric device as set forth in claim 1 wherein the electric conductors themselves consist essentially of material that is an isotropic conductor of electricity.

9. An electric device as set forth in claim 8 wherein the individual isotropic conductors comprise substantially straight wires that are circumferentially encased in hard coating and that have lengthwise end surfaces that collectively form a portion of the one surface of the medium along which the one element slides.

10. An electric device as set forth in claim 8 wherein the individual isotropic conductors are contained in partially insulated wires that are disposed sidebyside and bare of insulation along diametrically opposite portions of their circumferences to provide for current flow between those diametrically opposite portions while the partial insulation separates the wires from each other so that lateral current flow between the wires is prevented.

11. An electric device comprising: a medium that comprises generally parallel opposite surfaces, at least one of which is substantially flat, and low resistance electric conductors electrically separated by solid dielectric and aligned to conduct anisotropically in a favored direction between the opposite surfaces, the medium being interposed between first and second electric elements to provide a region of anisotropic, low resistance electrical connection between the first element and a defined reference point of the second element throughout a defined range of sliding travel of one of the elements along a flat one of the surfaces of the medium in a direction that is transverse to the favored anisotropic direction, wherein the medium comprises Low Temperature Co-Fired Ceramic (LTCC) tape having vias filled level to the one surface of the medium with electrically conductive material to support sliding travel of the one element and being co-fired to another ceramic material whose surface contains the second element.

12. An electric device as set forth in claim 11 wherein the first element comprises a wiper, and the electrically conductive material filling the vias comprises material that is chemically inert with respect to fluid forming an environment within which the wiper is disposed, that presents to the wiper a hardness that is greater than the hardness that the second element would present to the wiper, and that provides a coefficient of friction between the outer surface of the vias and the wiper that is less than the coefficient of friction that would be provided between the wiper and the second element.

13. An electric device as set forth in claim 1 wherein the medium comprises material that is chemically inert with respect to fluid forming an environment within which the first element is disposed.

14. An electric device as set forth in claim 1 wherein the coefficient of friction between the medium and the one element is less than the coefficient of friction that would be present between the one element and the second element.

15. An electric device comprising: a medium that comprises generally parallel opposite surfaces, at least one of which is substantially flat, and low resistance electric conductors electrically separated by solid dielectric and aligned to conduct anisotropically in a favored direction between the opposite surfaces, the medium being interposed between first and second electric elements to provide a region of anisotropic, low resistance electrical connection between the first element and a defined reference point of the second element throughout a defined range of sliding travel of one of the elements along a flat one of the surfaces of the medium in a direction that is transverse to the favored anisotropic direction, wherein the first element comprises a wiper and the medium comprises electrically anisotropic, highly conductive nanotubes substantially aligned macroscopically along the direction between the first element and the second element.

16. An electric device as set forth in claim 1 wherein the medium comprises a printed layer on the second element, the printed layer consisting of internal aniostropically aligned conductors of uniform height.

* * * * *